US006039820A

United States Patent [19]

Hinshaw et al.

[11] Patent Number: 6,039,820

[45] Date of Patent: Mar. 21, 2000

[54] METAL COMPLEXES FOR USE AS GAS GENERANTS

[75] Inventors: Jerald C. Hinshaw, Pleasant View; Daniel W. Doll, North Ogden; Reed J. Blau, Richmond, all of Utah; Gary K. Lund, Malad, Id.

[73] Assignee: Cordant Technologies Inc., Salt Lake City, Utah

[21] Appl. No.: 08/899,599

[22] Filed: Jul. 24, 1997

[51] Int. Cl.[7] ..... C06B 31/00

[52] U.S. Cl. ..... 149/45; 102/289

[58] Field of Search ..... 149/45; 102/289

[56] References Cited

U.S. PATENT DOCUMENTS

| | | | |
|---|---|---|---|
| 2,220,891 | 11/1940 | Cook et al. | 52/14 |
| 4,185,008 | 1/1980 | Caspari et al. | 260/45.8 A |
| 4,528,049 | 7/1985 | Udy et al. | 149/45 X |
| 5,160,386 | 11/1992 | Lund et al. | 149/45 X |
| 5,429,691 | 7/1995 | Hinshaw et al. | 149/45 |
| 5,608,183 | 3/1997 | Barnes et al. | 149/36 X |
| 5,673,935 | 10/1997 | Hinshaw et al. | 149/22 X |
| 5,725,699 | 3/1998 | Hinshaw et al. | 149/45 X |
| 5,735,118 | 4/1998 | Hinshaw et al. | 149/45 X |

*Primary Examiner*—Peter A. Nelson
*Attorney, Agent, or Firm*—Pillsbury Madison & Sutro LLP

[57] ABSTRACT

Gas generating compositions and methods for their use are provided. Metal complexes are used as gas generating compositions. These complexes are comprised of a metal cation template, a neutral ligand containing hydrogen and nitrogen, sufficient oxidizing anion to balance the charge of the complex, and at least one cool burning organic nitrogen-containing compound. The complexes are formulated such that when the complex combusts, nitrogen gas and water vapor is produced. Specific examples of such complexes include metal nitrite ammine, metal nitrate ammine, and metal perchlorate ammine complexes, as well as hydrazine complexes. A binder and co-oxidizer can be combined with the metal complexes to improve crush strength of the gas generating compositions and to permit efficient combustion of the binder. Such gas generating compositions are adaptable for use in gas generating devices such as automobile air bags.

49 Claims, No Drawings

METAL COMPLEXES FOR USE AS GAS GENERANTS

FIELD OF THE INVENTION

The present invention relates to complexes of transition metals or alkaline earth metals which are capable of combusting to generate gases. More particularly, the present invention relates to providing such complexes which rapidly oxidize to produce significant quantities of gases, particularly water vapor and nitrogen.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others have set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, $NO_x$, $SO_x$, and hydrogen sulfide.

The gas must be generated at a sufficiently and reasonably low temperature so that an occupant of the car is not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. In the absence of an acceptable alternative, the production of irritating particulates is one of the undesirable, but tolerated aspects of the currently used sodium azide materials.

In addition to producing limited, if any, quantities of particulates, it is desired that at least the bulk of any such particulates be easily filterable. For instance, it is desirable that the composition produce a filterable slag. If the reaction products form a filterable material, the products can be filtered and prevented from escaping into the surrounding environment.

Both organic and inorganic materials have been proposed as possible gas generants. Such gas generant compositions include oxidizers and fuels which react at sufficiently high rates to produce large quantities of gas in a fraction of a second.

At present, sodium azide is the most widely used and currently accepted gas generating material. Sodium azide nominally meets industry specifications and guidelines. Nevertheless, sodium azide presents a number of persistent problems. Sodium azide is highly toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, no matter what auxiliary oxidizer is employed, the combustion products from a sodium azide gas generant include caustic reaction products such as sodium oxide, or sodium hydroxide. Molybdenum disulfide or sulfur have been used as oxidizers for sodium azide. However, use of such oxidizers results in toxic products such as hydrogen sulfide gas and corrosive materials such as sodium oxide and sodium sulfide. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide might form explosive heavy metal azides or hydrazoic acid when contacted with battery acids following disposal.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with all of the criteria set forth above.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases and particulates produced by the operation of supplemental restraint systems.

It would, therefore, be a significant advance to provide compositions capable of generating large quantities of gas that would overcome the problems identified in the existing art. It would be a further advance to provide a gas generating composition which is based on substantially nontoxic starting materials and which produces substantially nontoxic reaction products. It would be another advance in the art to provide a gas generating composition which produces very limited amounts of toxic or irritating particulate debris and limited undesirable gaseous products. It would also be an advance to provide a gas generating composition which forms a readily filterable solid slag upon reaction.

Such compositions and methods for their use are disclosed and claimed herein.

BRIEF SUMMARY OF THE INVENTION

The present invention is related to the use of complexes of transition metals or alkaline earth metals as gas generating compositions. These complexes are comprised of a metal cation and a neutral ligand containing hydrogen and nitrogen. One or more oxidizing anions are provided to balance the charge of the complex. Examples of typical oxidizing anions which can be used include nitrates, nitrites, chlorates, perchlorates, peroxides, and superoxides. In some cases the oxidizing anion is part of the metal cation coordination complex. The complexes are formulated such that when the complex combusts, a mixture of gases containing nitrogen gas and water vapor are produced. A binder can be provided to improve the crush strength and other mechanical properties of the gas generant composition. A co-oxidizer can also be provided primarily to permit efficient combustion of the binder. Importantly, the production of undesirable gases or particulates is substantially reduced or eliminated.

Specific examples of the complexes used herein include metal nitrite ammines, metal nitrate ammines, metal perchlorate ammines, metal nitrite hydrazines, metal nitrate hydrazines, metal perchlorate hydrazines, and mixtures thereof. The complexes within the scope of the present invention rapidly combust or decompose to produce significant quantities of gas.

The metals incorporated within the complexes are transition metals, alkaline earth metals, metalloids, or lanthanide complexes. The presently preferred metal is cobalt. Other metals which also form complexes with the properties desired in the present invention include, for example, magnesium, manganese, nickel, titanium, copper, chromium, zinc, and tin. Examples of other usable metals include rhodium, iridium, ruthenium, palladium, and platinum. These metals are not as preferred as the metals mentioned above, primarily because of cost considerations.

The transition metal cation or alkaline earth metal cation acts as a template or coordination center for the transition metal complex. As mentioned above, the complex includes a neutral ligand containing hydrogen and nitrogen. This neutral ligand is preferably ammonia or a substituted ammonia ligand such as hydrazine or a substituted hydrazine ligand. If carbon is present in this neutral ligand, this neutral ligand is preferably aliphatic in nature rather than aromatic. More preferably, the neutral ligand is substantially or totally based on nitrogen and hydrogen atoms and contains few if any carbon atoms. Neutral ligands containing hydrogen and nitrogen are described in F. A. Cotton and G. Wilkinson's *Advanced Inorganic Chemistry, A Comprehensive Text,* 4th Ed., Wiley-Interscience, 1980, pages 118–132, which is hereby incorporated by reference. Currently preferred neutral ligands are $NH_3$ and $N_2H_4$. One or more oxidizing anions may also be coordinated with the metal cation. Examples of metal complexes within the scope of the present invention include $Cu(NH_3)_4(NO_3)_2$ (tetraamminecopper(II) nitrate), $Co(NH_3)_3(NO_2)_3$ (trinitrotriamminecobalt(III)), $Co(NH_3)_6(ClO_4)_3$ (hexaamminecobalt(III) perchlorate), $Co(NH_3)6(NO_3)_3$ (hexaamminecobalt(III) nitrate), $Zn(N_2H_4)3(NO_3)_2$ (tris-hydrazine zinc nitrate), $Mg(N_2H_4)_2(ClO_4)_2$ (bis-hydrazine magnesium perchlorate), and $Pt(NO_2)_2(NH_2NH_2)_2$ (bis-hydrazine platinum(II) nitrite).

It is within the scope of the present invention to include metal complexes which contain a common ligand in addition to the neutral ligand. A few typical common ligands include: aquo ($H_2O$), hydroxo (OH), carbonato ($CO_3$), oxalato ($C_2O_4$), cyano (CN), isocyanato (NC), chloro (Cl), fluoro (F), and similar ligands. The metal complexes within the scope of the present invention are also intended to include a common counter ion, in addition to the oxidizing anion, to help balance the charge of the complex. A few typical common counter ions include: hydroxide ($OH^-$), chloride ($Cl^-$), fluoride ($F^-$), cyanide ($CN^-$), carbonate ($CO_3^{-2}$), phosphate ($PO_4^{-3}$), oxalate ($C_2O_4^{-2}$), borate ($BO_4^{-5}$) ammonium ($NH_4^+$), and the like.

It is observed that metal complexes containing the described neutral ligands and oxidizing anions combust rapidly to produce significant quantities of gases. Combustion can be initiated by the application of heat or by the use of conventional igniter devices.

DETAILED DESCRIPTION OF THE INVENTION

As discussed above, the present invention is related to gas generant compositions containing complexes of transition metals or alkaline earth metals. These complexes are comprised of a metal cation template and a neutral ligand containing hydrogen and nitrogen. One or more oxidizing anions are provided to balance the charge of the complex. In some cases the oxidizing anion is part of the coordination complex with the metal cation. Examples of typical oxidizing anions which can be used include nitrates, nitrites, chlorates, perchlorates, peroxides, and superoxides. The complexes can be combined with a binder or mixture of binders to improve the crush strength and other mechanical properties of the gas generant composition. A co-oxidizer can be provided primarily to permit efficient combustion of the binder.

Metal complexes which include at least one common ligand in addition to the neutral ligand are also included within the scope of the present invention. As used herein, the term common ligand includes well known ligands used by inorganic chemists to prepare coordination complexes with metal cations. The common ligands are preferably polyatomic ions or molecules, but some monoatomic ions, such as halogen ions, may also be used. Examples of common ligands within the scope of the present invention include aquo ($H_2O$), hydroxo (OH), perhydroxo ($O_2H$), peroxo ($O_2$), carbonato ($CO_3$), oxalato ($C_2O_4$), carbonyl (CO), nitrosyl (NO), cyano (CN), isocyanato (NC), isothiocyanato (NCS), thiocyanato (SCN), chloro (Cl), fluoro (F), amido ($NH_2$), imdo (NH), sulfato ($SO_4$), phosphate ($PO_4$), ethylenediaminetetraacetic acid (EDTA), and similar ligands. See, F. Albert Cotton and Geoffrey Wilkinson, *Advanced Inorganic Chemistry,* 2nd ed., John Wiley & Sons, pp. 139–142, 1966 and James E. Huheey, *Inorganic Chemistry,* 3rd ed., Harper & Row, pp. A-97-A-107, 1983, which are incorporated herein by reference. Persons skilled in the art will appreciate that suitable metal complexes within the scope of the present invention can be prepared containing a neutral ligand and another ligand not listed above.

In some cases, the complex can include a common counter ion, in addition to the oxidizing anion, to help balance the charge of the complex. As used herein, the term common counter ion includes well known anions and cations used by inorganic chemists as counter ions. Examples of common counter ions within the scope of the present invention include hydroxide ($OH^-$), chloride ($Cl^-$), fluoride ($F^-$), cyanide ($CN^-$), thiocyanate ($SCN^-$), carbonate ($CO_3^{-2}$), sulfate ($SO_4^{-2}$), phosphate ($PO_4^{-3}$), oxalate ($C_2O_4^{-2}$), borate ($BO_4^{-5}$), ammonium ($NH_4^+$), and the like. See, Whitten, K. W., and Gailey, K. D., *General Chemistry,* Saunders College Publishing, p. 167, 1981 and James E. Huheey, *Inorganic Chemistry,* 3rd ed., Harper & Row, pp. A-97-A-103, 1983, which are incorporated herein by reference.

The gas generant ingredients are formulated such that when the composition combusts, nitrogen gas and water vapor are produced. In some cases, small amounts of carbon dioxide or carbon monoxide are produced if a binder, co-oxidizer, common ligand or oxidizing anion contain carbon. The total carbon in the gas generant composition is carefully controlled to prevent excessive generation of CO gas. The combustion of the gas generant takes place at a rate sufficient to qualify such materials for use as gas generating compositions in automobile air bags and other similar types of devices. Importantly, the production of other undesirable gases or particulates is substantially reduced or eliminated.

Complexes which fall within the scope of the present invention include metal nitrate ammines, metal nitrite ammines, metal perchlorate ammines, metal nitrite hydrazines, metal nitrate hydrazines, metal perchlorate hydrazines, and mixtures thereof. Metal ammine complexes are defined as coordination complexes including ammonia as the coordinating ligand. The ammine complexes can also have one or more oxidizing anions, such as nitrite ($NO_2^-$), nitrate ($NO_3^-$), chlorate ($ClO_3^-$), perchlorate ($ClO_4^-$), peroxide ($O_2^{2-}$), and superoxide ($O_2^-$), or mixtures thereof, in the complex. The present invention also relates to similar metal hydrazine complexes containing corresponding oxidizing anions.

It is suggested that during combustion of a complex containing nitrite and ammonia groups, the nitrite and ammonia groups undergo a diazotization reaction. This reaction is similar, for example, to the reaction of sodium nitrite and ammonium sulfate, which is set forth as follows:

$$2NaNO_2+(NH_4)_2SO_4 \rightarrow Na_2SO_4+4H_2O+2N_2$$

Compositions such as sodium nitrite and ammonium sulfate in combination have little utility as gas generating substances. These materials are observed to undergo metathesis reactions which result in unstable ammonium nitrite. In addition, most simple nitrite salts have limited stability.

In contrast, the metal complexes used in the present invention are stable materials which, in certain instances, are capable of undergoing the type of reaction set forth above. The complexes of the present invention also produce reaction products which include desirable quantities of nontoxic gases such as water vapor and nitrogen. In addition, a stable metal, or metal oxide slag is formed. Thus, the compositions of the present invention avoid several of the limitations of existing sodium azide gas generating compositions.

Any transition metal, alkaline earth metal, metalloid, or lanthanide metal which is capable of forming the complexes described herein is a potential candidate for use in these gas generating compositions. However, considerations such as cost, reactivity, thermal stability, and toxicity may limit the most preferred group of metals.

The presently preferred metal is cobalt. Cobalt forms stable complexes which are relatively inexpensive. In addition, the reaction products of cobalt complex combustion are relatively nontoxic. Other preferred metals include magnesium, manganese, copper, zinc, and tin. Examples of less preferred but usable metals include nickel, titanium, chromium, rhodium, iridium, ruthenium, and platinum.

A few representative examples of ammine complexes within the scope of the present invention, and the associated gas generating decomposition reactions are as follows:

$Cu(NH_3)_2(NO_2)_2 \rightarrow CuO + 3H_2O + 2N_2$
$2Co(NH_3)_3(NO_2)_3 \rightarrow 2CoO + 9H_2O + 6N_2 + ½O_2$
$2Cr(NH_3)_3(NO_2)_3 \rightarrow Cr_2O_3 + 9H_2O + 6N_2$
$[Cu(NH_3)_4 (NO_30_2 \rightarrow Cu + 3N_2 + 6H_2O$
$2B + 3Co(NH_3)_6Co(NO_2)_6 \rightarrow 6CoO + B_2O_3 + 27H_2O + 18N_2$
$Mg + Co(NH_3)_4(NO_2)_2Co(NH_3O_2(NO_2)_4 \rightarrow 2CoO + MgO + 9H_2O + 6N_2$
$10[Co(NH_3)_4(NO_2)_2](NO_2) + 2Sr(NO_3)_2 \rightarrow 10CoO + 2SrO + 37N_2 + 60H_2O$
$18[Co(NH_3)_6 (NO_3)_3 + 4Cu_2(OH)_3NO_3 \rightarrow 18CoO + 8Cu + 82N_2 + 168H_2O$
$2[Co(NH_3)_6](NO_3)_3 + 2NH_4NO_3 \rightarrow 2CoO + 11N_2 + 22H_2O$
$TiCl_4(NH_3)_2 + 3BaO_2 \rightarrow TiO_2 + 2BaCl_2 + BaO + 2H_2O + N_2$
$4[Cr(NH_3)_5OH](ClO_4)_2 + [SnCl_4(NH_3)_2] \rightarrow 4CrCl_3 + SnO + 35H_2O + 11N_2$
$10[Ru(NH_3)_5N_2](NO_3)_2 + 3Sr(NO_3)_2 \rightarrow 3SrO + 10Ru + 48N_2 + 75H_2O$
$[Ni(H_2O)_2(NH_30_4](NO_3)_2 \rightarrow Ni + 3N_2 + 8H_2O$
$2[Cr(O_2)_2(NH_3)_3 + 4NH_4NO_3 \rightarrow 7N_2 + 17H_2O + Cr_2O_3$
$2[Sm(O_2)_3(NH_3)] + 4[Gd(NH_3)_9](ClO_4)_3 \rightarrow Sm_2O_3 + 4GdCl_3 +$ -continued $19N_2 + 57H_2O$
$2Er(NO_3)_3(NH_3)_3 + 2[Co(NH_3)_6](NO_3)_3 \rightarrow Er_2O_3 + 12CoO + 60N_2117H_2O$ A few representative examples of hydrazine complexes within the scope of the present invention, and related gas generating reactions are as follows:

$5Zn(N_2H_4)(NO_3)_2 + Sr(NO_3)_2 \rightarrow 5ZnO + 21N_2 + 30H_2O + SrO$
$Co(N_2H_{43}(NO_3)_2 \rightarrow Co + 4N_2 + 6H_2O$
$3Mg(N_2H_4)_2(ClO_4)_2 + 2Si_3N_4 \rightarrow 6SiO_2 + 3MgCl_2 + 10N_2 + 12H_2O$
$2Mg(N_2H_4)_2(NO_3)_2 + 2[Co(NH_3)_4(NO_2)_2]NO_2 \rightarrow 2MgO + 2CoO + 13N_2 + 20H_2O$
$Pt(NO_2)_2(N_2H_4)_2 \rightarrow Pt + 3N_2 + 4H_2O$
$[Mn(N_2H_4)_3](NO_3)_2 + Cu(OH)_2 \rightarrow Cu + MnO + 4N_2 + 7H_2O$
$2[La(N_2H_4)_4(NO_3)](NO_3)_2 + NH_4NO_3 \rightarrow La_2O + 12N_2 + 18H_2O$ While the complexes of the present invention are relatively stable, it is also simple to initiate the combustion reaction. For example, if the complexes are contacted with a hot wire, rapid gas producing combustion reactions are observed. Similarly, it is possible to initiate the reaction by means of conventional igniter devices. One type of igniter device includes a quantity of $B/KNO_3$ granules or pellets which is ignited, and which in turn is capable of igniting the compositions of the present invention. Another igniter device includes a quantity of $Mg/Sr(NO_3)_2$/nylon granules.

It is also important to note that many of the complexes defined above undergo "stoichiometric" decomposition. That is, the complexes decompose without reacting with any other material to produce large quantities of nitrogen and water, and a metal or metal oxide. However, for certain complexes it may be desirable to add a fuel or oxidizer to the complex in order to assure complete and efficient reaction. Such fuels include, for example, boron, magnesium, aluminum, hydrides of boron or aluminum, carbon, silicon, titanium, zirconium, and other similar conventional fuel materials, such as conventional organic binders. Oxidizing species include nitrates, nitrites, chlorates, perchlorates, peroxides, and other similar oxidizing materials. Thus, while stoichiometric decomposition is attractive because of the simplicity of the composition and reaction, it is also possible to use complexes for which stoichiometric decomposition is not possible.

As mentioned above, nitrate and perchlorate complexes also fall within the scope of the invention. A few representative examples of such nitrate complexes include: $Co(NH_3)_6(NO_3)_3$, $Cu(NH_3)_4(NO_3)_2$, $[Co(NH_3)_5(NO_3)](NO_3)_2$, $[Co(NH_3)_5(NO_2)](NO_3)_2$, $[Co(NH_3)_5(H_2O)](NO_3)_2$. A few representative examples of perchlorate complexes within the scope of the invention include: $[Co(NH_3)_6](ClO_4)_3$, $[Co(NH_3)_5(NO_2)]ClO_4$, $[Mg(N_2H_4)_2](ClO_4)_2$.

Preparation of metal nitrite or nitrate ammine complexes of the present invention is described in the literature. Specifically, reference is made to Hagel et al., "The Triamines of Cobalt (III). I. Geometrical Isomers of Trinitrotriamminecobalt(III)," 9 *Inorganic Chemistry* 1496 (June 1970); G. Pass and H. Sutcliffe, *Practical Inorganic Chemistry,* 2nd Ed., Chapman & Hull, New York, 1974; Shibata et al., "Synthesis of Nitroammine- and Cyanoamminecobalt(III) Complexes With Potassium Tricarbonatocobaltate(III) as the Starting Material," 3 *Inorganic Chemistry* 1573 (Nov. 1964); Wieghardt et al., "$\mu$-Carboxylatodi-$\mu$-hydroxo-bis[triamminecobalt(III)] Complexes," 23 *Inorganic Synthesis* 23 (1985); Laing, "mer- and fac-[$Co(NH_3)_3NO_2)_3$]: Do They Exist?"62 *J. Chem Educ.,* 707 (1985); Siebert, "Isomere des Trinitrotriamminkobalt (III)," 441 *Z. Anorg. Allg. Chem.* 47 (1978); all of which are incorporated herein by this reference. Transition metal perchlorate ammine complexes are synthesized by similar methods. As mentioned above, the ammine complexes of the present invention are generally stable and safe for use in preparing gas generating formulations.

Preparation of metal perchlorate, nitrate, and nitrite hydrazine complexes is also described in the literature. Specific reference is made to Patil et al., "Synthesis and Characterisation of Metal Hydrazine Nitrate, Azide, and Perchlorate Complexes," 12 *Synthesis and Reactivity In Inorganic and Metal Organic Chemistry,* 383 (1982); Klyichnikov et al., "Preparation of Some Hydrazine Compounds of Palladium," 13 *Russian Journal of Inorganic Chemistry,* 416 (1968); Klyichnikov et al., "Conversion of Mononuclear Hydrazine Complexes of Platinum and Palladium Into Binuclear Complexes," 36 *Ukr. Khim. Zh.,* 687 (1970).

The described complexes can be processed into usable granules or pellets for use in gas generating devices. Such devices include automobile air bag supplemental restraint systems. Such gas generating compositions will comprise a quantity of the described complexes and preferably, a binder and a co-oxidizer. The compositions produce a mixture of gases, principally nitrogen and water vapor, upon decomposition or burning. The gas generating device will also include means for initiating the burning of the composition, such as a hot wire or igniter. In the case of an automobile air bag system, the system will include the compositions described above; a collapsed, inflatable air bag; and means for igniting said gas-generating composition within the air bag system. Automobile air bag systems are well known in the art.

Typical binders used in the gas generating compositions of the present invention include binders conventionally used in propellant, pyrotechnic and explosive compositions including, but not limited to, lactose, boric acid, silicates including magnesium silicate, polypropylene carbonate, polyethylene glycol, naturally occurring gums such as guar gum, acacia gum, modified celluloses and starches (a detailed discussion of such gums is provided by C. L. Mantell, *The Water-Soluble Gums,* Reinhold Publishing Corp., 1947, which is incorporated herein by reference), polyacrylic acids, nitrocellulose, polyacrylamide, polyamides, including nylon, and other conventional polymeric binders. Such binders improve mechanical properties or provide enhanced crush strength. Although water immiscible binders can be used in the present invention, it is currently preferred to use water soluble binders. The binder concentration is preferably in the range from 0.5 to 12% by weight, and more preferably from 2% to 8% by weight of the gas generant composition.

Applicants have found that the addition of carbon such as carbon black or activated charcoal to gas generant compositions improves binder action significantly perhaps by reinforcing the binder and thus, forming a micro-composite. Improvements in crush strength of 50% to 150% have been observed with the addition of carbon black to compositions within the scope of the present invention. Ballistic reproducibility is enhanced as crush strength increases. The carbon concentration is preferably in the range of 0.1% to 6% by weight, and more preferably from 0.3 to 3% by weight of the gas generant composition.

The co-oxidizer can be a conventional oxidizer such as alkali, alkaline earth, lanthanide, or ammonium perchlorates, chlorates, peroxides, nitrites, and nitrates, including for example, $Sr(NO_3)_2$, $NH_4ClO_4$, $KNO_3$, and $(NH_4)_2Ce(NO_3)_6$.

The co-oxidizer can also be a metal containing oxidizing agent such as metal oxides, metal hydroxides, metal peroxides, metal oxide hydrates, metal oxide hydroxides, metal hydrous oxides, and mixtures thereof, including those described in U.S. Pat. No. 5,439,537 issued Aug. 8, 1995, titled "Thermite Compositions for Use as Gas Generants," which is incorporated herein by reference. Examples of metal oxides include, among others, the oxides of copper, cobalt, manganese, tungsten, bismuth, molybdenum, and iron, such as CuO, $CO_2O_3$, $Co_3O_4$, $CoFe_2O_4$, $Fe_2O_3$, $MoO_3$, $Bi_2MoO_6$, and $Bi_2O_3$. Examples of metal hydroxides include, among others, $Fe(OH)_3$, $Co(OH)_3$, $Co(OH)_2$, $Ni(OH)_2$, $CU(OH)_2$, and $Zn(OH)_2$. Examples of metal oxide hydrates and metal hydrous oxides include, among others, $Fe_2O_3.xH_2O$, $SnO_2.xH_2O$, and $MoO_3.H_2O$. Examples of metal oxide hydroxides include, among others, $CoO(OH)_2$, $FeO(OH)_2$, $MnO(OH)_2$ and $MnO(OH)_3$.

The co-oxidizer can also be a basic metal carbonate such as metal carbonate hydroxides, metal carbonate oxides, metal carbonate hydroxide oxides, and hydrates and mixtures thereof and a basic metal nitrate such as metal hydroxide nitrates, metal nitrate oxides, and hydrates and mixtures thereof, including those oxidizers described in U.S. Pat. No. 5,429,691, titled "Thermite Compositions for use as Gas Generants," which is incorporated herein by reference.

Table 1, below, lists examples of typical basic metal carbonates capable of functioning as co-oxidizers in the compositions of the present invention:

TABLE 1

| Basic Metal Carbonates |
|---|
| $Cu(CO_3)_{1-x}.Cu(OH)_{2x}$, e.g., $CuCO_3.Cu(OH)_2$ (malachite) |
| $Co(CO_3)_{1-x}(OH)_{2x}$, e.g., $2Co(CO_3).3Co(OH)_2.H_2O$ |
| $Co_xFe_y(CO_3)_2(OH)_2$, e.g., $Co_{0.69}Fe_{0.34}(CO_3)_{0.2}(OH)_2$ |
| $Na_3[Co(CO_3)_3].3H_2O$ |
| $Zn(CO_3)_{1-x}(OH)_{2x}$, e.g., $Zn_2(CO_3)(OH)_2$ |
| $Bi_AMg_B(CO_3)_C(OH)_D$, e.g., $Bi_2Mg(CO_3)_2(OH)_4$ |
| $Fe(CO_3)_{1-x}(OH)_{3x}$, e.g., $Fe(CO_3)_{0.12}(OH)_{2.76}$ |
| $Cu_{2-x}Zn_x(CO_3)_{1-y}(OH)_{2y}$, e.g., $Cu_{1.54}Zn_{0.46}(CO_3)(OH)_2$ |
| $Co_yCu_{2-y}(CO_3)_{1-x}(OH)_{2x}$, e.g., $Co_{0.49}Cu_{0.51}(CO_3)_{0.43}(OH)_{1.1}$ |
| $Ti_ABi_B(CO_3)_x(OH)_y(O)_z(H_2O)_c$, e.g., $Ti_3Bi_4(CO_3)_2(OH)_2O_9(H_2O)_2$ |
| $(BiO)_2CO_3$ |

Table 2, below, lists examples of typical basic metal nitrates capable of functioning as co-oxidizers in the compositions of the present invention:

TABLE 2

| Basic Metal Nitrates |
|---|
| $Cu_2(OH)_3NO_3$ (gerhardite) |
| $Co_2(OH)_3NO_3$ |
| $Cu_xCo_{2-x}(OH)_3NO_3$, e.g., $CuCo(OH)_3NO_3$ |
| $Zn_2(OH)_3NO_3$ |
| $Mn(OH)_2NO_3$ |
| $Fe(NO_3)_n(OH)_{3-n}$, e.g., $Fe_4(OH)_{11}NO_3.2H_2O$ |
| $Mo(NO_3)_2O_2$ |
| $BiONO_3.H_2O$ |
| $Ce(OH)(NO_3)_3.3H_2O$ |

In certain instances it will also be desirable to use mixtures of such oxidizing agents in order to enhance ballistic properties or maximize filterability of the slag formed from combustion of the composition.

The present compositions can also include additives conventionally used in gas generating compositions, propellants, and explosives, such as burn rate modifiers, slag formers, release agents, and additives which effectively remove $NO_x$. Typical burn rate modifiers include $Fe_2O_3$, $K_2B_{12}H_{12}$, $Bi_2MoO_6$, and graphite carbon powder or fibers. A number of slag forming agents are known and include, for example, clays, talcs, silicon oxides, alkaline earth oxides, hydroxides, oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, calcium stearate, or boron nitride.

Typical ignition aids/burn rate modifiers which can be used herein include metal oxides, nitrates and other compounds such as, for instance, $Fe_2O_3$, $K_2B_{12}H_{12}.H_2O$, $BiO(NO_3)$, $CO_2O_3$, $CoFe_2O_4$, $CuMoO_4$, $Bi_2MoO_6$, $MnO_2$, $Mg(NO_3)_2.xH_2O$, $Fe(NO_3)_3.xH_2O$, $Co(NO_3)_2.xH_2O$, and $NH_4NO_3$. Coolants include magnesium hydroxide, cupric oxalate, boric acid, aluminum hydroxide, and silicotungstic acid. Coolants such as aluminum hydroxide and silicotungstic acid can also function as slag enhancers.

It will be appreciated that many of the foregoing additives may perform multiple functions in the gas generant formulation such as a co-oxidizer or as a fuel, depending on the compound. Some compounds may function as a co-oxidizer, burn rate modifier, coolant, and/or slag former.

Several important properties of typical hexaamminecobalt (III) nitrate gas generant compositions within the scope of the present invention have been compared with those of commercial sodium azide gas generant compositions. These properties illustrate significant differences between conventional sodium azide gas generant compositions and gas generant compositions within the scope of the present invention. These properties are summarized below:

| Property | Typical Invention Range | Typical Sodium Azide |
|---|---|---|
| Flame Temperature | 1850–2050° K. | 1400–1500° K. |
| Gas Fraction of Generant | 0.65–0.85 | 0.4–0.45 |
| Total Carbon Content in Generant | 0–3.5% | trace |
| Burn Rate of Generant at 1000 psi | 0.10–0.35 ips | 1.1–1.3 ips |
| Surface Area of Generant | 2.0–3.5 $cm^2/g$ | 0.8–0.85 $cm^2/g$ |
| Charge Weights in Generator | 30–45 g | 75–90 g |

The term "gas fraction of generant" means the weight fraction of gas generated per weight of gas generant. Typical hexaamminecobalt(III) nitrate gas generant compositions have more preferred flame temperatures in the range from 1850°K to 1900°K, gas fraction of generant in the range from 0.70 to 0.75, total carbon content in the generant in the range from 1.5% to 3.0% burn rate of generant at 1000 psi in the range from 0.2 ips to 0.35 ips, and surface area of generant in the range from 2.5 $cm^2/g$ to 3.5 $cm^2/g$.

The gas generating compositions of the present invention are readily adapted for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening, a pre-determined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, helium and mixtures thereof. The mixed and heated gases exit the pressure tank through the opening and ultimately exit the hybrid inflator and deploy an inflatable bag or balloon, such as an automobile air bag.

Preferred embodiments of the invention yield combustion products with a temperature greater than about 1800°K, the heat of which is transferred to the cooler inert gas causing a further improvement in the efficiency of the hybrid gas generating system.

Hybrid gas generating devices for supplemental safety restraint application are described in Frantom, Hybrid Airbag Inflator Technology, *Airbag Int'l Symposium on Sophisticated Car Occupant Safety Systems,* (Weinbrenner-Saal, Germany, Nov. 2–3, 1992).

An additional preferred embodiment of the present invention is the incorporation of at least one cool burning organic nitrogen compound such as, for example, guanidine nitrate into the gas generant composition. A cool burning organic nitrogen compound is a compound having a relatively low heat of formation. In general, the cool burning compound's heat of formation can be less than about −400 cal/g, and preferably, less than about −600 cal/g. The heat of formation for guanidine nitrate, for example, is about −747 cal/g.

In this preferred embodiment, the cool burning organic nitrogen compound is not the primary fuel of the formulation but a secondary fuel. Fuels already disclosed above such as, for example, hexamminecobalt nitrate, may serve as the primary fuel.

In addition, a substance such as guanidine nitrate may also have some oxidizing capacity because of the presence of, for example, the nitrate group. However, the cool burning organic nitrogen compound is not the principle oxidizing agent. It may, however, act as a secondary oxidizing agent or a co-oxidizer together with other oxidizing or co-oxidizing substances noted above such as, for example, basic copper nitrate.

Besides guanidine nitrate, additional cool burning organic nitrogen compounds for this preferred embodiment include guanidine salts such as, for example, the carbonate salt and guanidine derivatives such as, for example, aminoguanidine nitrate, diaminoguanidine nitrate, triaminoguanidine nitrate, nitroguanidine, urea, glycine, glycine-ammonium nitrate complexes, and ethylene diamine dinitrate. However, guanidine nitrate is preferred. Mixtures of cool burning organic nitrogen compounds may be used.

In principle, for this preferred embodiment, the amount of cool burning organic nitrogen compound incorporated into the composition can be generally more than 0 wt. % and less than about 40 wt. %, and preferably, between about 5 wt. % and about 30 wt. %, and more preferably, between about 10 wt. % and about 25 wt. %. This embodiment of the present invention is not limited by theory, however, and in practice, the amount can be determined by a person skilled in the art depending on what performance characteristics are most important for the particular air bag application.

In this preferred embodiment, use of the cool burning organic nitrogen compound results in high gas output with simultaneously improved filterability of the slag produced from combustion. Furthermore, the overall cost of the composition can be reduced when a relatively less expensive cool burning organic nitrogen compound such as guanidine nitrate replaces a relatively more expensive ingredient such as, for example, hexaamminecobalt nitrate. In principle, the amount of $NO_x$, also may be reduced.

In this preferred embodiment, preferred gas generant compositions comprise cool burning organic nitrogen compounds, and in addition, also comprise: 1) at least one one primary fuel such as a metal complex like, for example, hexamminecoabalt nitrate, $Co(NH_3)_6(NO_3)_3$, which is different than the cool burning organic nitrogen compound, 2) a co-oxidizer such as, for example, basic copper nitrate, $Cu_2(OH)_3NO_3$, which is different than the cool burning organic nitrogen compound, and 3) a binder which is preferably a water soluble binder such as, for example, guar gum.

In general, in this preferred embodiment, fuels, co-oxidizers, and binders can be used which have previously been described herein. However, preferred examples of fuels for this preferred embodiment include cobalt ammine complexes, and hexaammincobalt nitrate is particularly preferred. Preferred examples of co-oxidizer include basic metal carbonates, basic metal nitrates, metal oxides, metal nitrates, and metal hydroxides. Basic copper nitrate is particularly preferred. Preferred examples of binders include water soluble or substantially water soluble polymers including gums. Guar gum is particularly preferred.

The amounts of the ingredients such as fuel, co-oxidizer, and binder in this preferred embodiment can be readily determined by a person of skill in the art in view of the present disclosure. In particular, however, the amount of primary fuel, which is apart from the cool burning organic nitrogen compound, generally can be between about 30 wt. % and about 90 wt. %, and preferably, between about 40 wt. % and about 75 wt. %. The sum of the amount of co-oxidizer, taken together with the amount of cool burning organic nitrogen compound, generally can be between about 10 wt. % and about 60 wt. %, and preferably, between about 15 wt. % and about 50 wt. %. The amount of binder generally can be between about 0.5 wt. % and about 12 wt. %, and preferably, between about 2 wt. % and about 10 wt. % and more preferably, between about 3 wt. % and about 6 wt. %. Although in theory, compositions are generally used that are stoichiometrically balanced, in practice, compositions are often at least slightly fuel rich, although slightly oxygen rich compositions are possible in principle. Typically, the level of ingredients is adjusted to give the best balance of performance with respect to, for example, effluent gases and slag characteristics.

Preferably, the composition also contains small amounts of carbon such as, for example, carbon black as a ballistic additive or burn rate modifier, although this is optional. The amount of carbon black, typically, can be less than about 2 wt. %, and preferably, less than about 1 wt. %.

The cool burning organic nitrogen compound can be used to replace partially the fuel ingredient. In this case, the amount of co-oxidizer can be increased to maintain the desired stoichiometry. This may result in cost savings because, for example, both basic copper nitrate and guanidine nitrate are significantly less costly than hexamminecobalt nitrate. Surprisingly, however, the overall performance of the generant is maintained despite the replacement. The maintenance of overall performance is achieved from a volume perspective because the density of the mixture increases as the relative proportion of basic copper nitrate increases.

In general, little if any chemical reaction is believed to occur when guanidine nitrate is mixed into the compositions, although the present invention is not bound by such theory of chemical reaction. Formulations can be prepared by blending individual ingredients, or alternatively, by preparing separate formulations and blending these formulations. Blending individual ingredients is generally preferred. Mixing can be accomplished by conventional procedures with conventional equipment known in the art, followed by shaping or pelleting the composition.

EXAMPLES

The present invention is further described in the following non-limiting examples. Unless otherwise stated, the compositions are expressed in weight percent.

Example 1

A quantity (132.4 g) of $Co(NH_3)_3(NO_2)_3$, prepared according to the teachings of Hagel et al., "The Triamines of cobalt (III). I. Geometrical Isomers of Trinitrotriamminecobalt(III)," 9 *Inorganic Chemistry* 1496 (June 1970), was slurried in 35 mL of methanol with 7 g of a 38 percent by weight solution of pyrotechnic grade vinyl acetate/vinyl alcohol polymer resin commonly known as VAAR dissolved in methyl acetate. The solvent was allowed to partially evaporate. The paste-like mixture was forced through a 20-mesh sieve, allowed to dry to a stiff consistency, and forced through a sieve yet again. The granules resulting were then dried in vacuo at ambient temperature for 12 hours. One-half inch diameter pellets of the dried material were prepared by pressing. The pellets were combusted at several different pressures ranging from 600 to 3,300 psig. The burning rate of the generant was found to be 0.237 inches per second at 1,000 psig with a pressure exponent of 0.85 over the pressure range tested.

Example 2

The procedure of Example 1 was repeated with 100 g of $Co(NH_3)_3(NO_2)_3$ and 34 g of 12 percent by weight solution of nylon in methanol. Granulation was accomplished via 10- and 16-mesh screens followed by air drying. The burn rate of this composition was found to be 0.290 inches per second at 1,000 psig with a pressure exponent of 0.74.

Example 3

In a manner similar to that described in Example 1, 400 g of $Co(NH_3)_3(NO_2)_3$ was slurried with 219 g of a 12 percent by weight solution of nitrocellulose in acetone. The nitrocellulose contained 12.6 percent nitrogen. The solvent was allowed to partially evaporate. The resulting paste was forced through an 8-mesh sieve followed by a 24-mesh sieve. The resultant granules were dried in air overnight and blended with sufficient calcium stearate mold release agent to provide 0.3 percent by weight in the final product. A portion of the resulting material was pressed into ½-inch diameter pellets and found to exhibit a burn rate of 0.275 inches per second at 1,000 psig with a pressure exponent of 0.79. The remainder of the material was pressed into pellets ⅛-inch diameter by 0.07-inch thickness on a rotary tablet press. The pellet density was determined to be 1.88 g/cc. The theoretical flame temperature of this composition was 2,358°K and was calculated to provide a gas mass fraction of 0.72.

Example 4

This example discloses the preparation of a reusable stainless steel test fixture used to simulate driver's side gas generators. The test fixture, or simulator, consisted of an igniter chamber and a combustion chamber. The igniter chamber was situated in the center and had 24, 0.10 inch diameter ports exiting into the combustion chamber. The igniter chamber was fitted with an igniter squib. The igniter chamber wall was lined with 0.001 inch thick aluminum foil before −24/+60 mesh igniter granules were added. The outer combustion chamber wall consisted of a ring with nine exit ports. The diameter of the ports was varied by changing rings. Starting from the inner diameter of the outer combustion chamber ring, the combustion chamber was fitted with a 0.004 inch aluminum shim, one wind of 30 mesh stainless steel screen, four winds of a 14 mesh stainless steel screen, a deflector ring, and the gas generant. The generant was held intact in the combustion chamber using a "donut" of 18 mesh stainless steel screen. An additional deflector ring was placed around the outside diameter of the outer combustion chamber wall. The combustion chamber was fitted with a pressure port. The simulator was attached to either a 60 liter tank or an automotive air bag. The tank was fitted with pressure, temperature, vent, and drain ports. The automotive air bags have a maximum capacity of 55 liters and are constructed with two ½ inch diameter vent ports. Simulator tests involving an air bag were configured such that bag pressures were measured. The external skin surface temperature of the bag was monitored during the inflation event by infrared radiometry, thermal imaging, and thermocouple.

Example 5

Thirty-seven and one-half grams of the ⅛-inch diameter pellets prepared as described in Example 3 were combusted in an inflator test device vented into a 60 L collection tank as described in Example 4, with the additional incorporation of a second screened chamber containing 2 winds of 30 mesh screen and 2 winds of 18 mesh screen. The combustion produced a combustion chamber pressure of 2,000 psia and a pressure of 39 psia in the 60 L collection tank. The temperature of the gases in the collection tank reached a maximum of 670°K at 20 milliseconds. Analysis of the gases collected in the 60 L tank showed a concentration of nitrogen oxides ($NO_x$) of 500 ppm and a concentration of carbon monoxide of 1,825 ppm. Total expelled particulate as determined by rinsing the tank with methanol and evaporation of the rinse was found to be 1,000 mg.

Example 6

The test of Example 4 was repeated except that the 60 L tank was replaced with a 55 L vented bag as typically employed in driver side automotive inflator restraint devices. A combustion chamber pressure of 1,900 psia was obtained with a full inflation of the bag occurring. An internal bag pressure of 2 psig at peak was observed at approximately 60 milliseconds after ignition. The bag surface temperature was observed to remain below 83° C. which is an improvement over conventional azide-based inflators, while the bag inflation performance is quite typical of conventional systems.

Example 7

The nitrate salt of copper tetraammine was prepared by dissolving 116.3 g of copper(II) nitrate hemipentahydrate in 230 mL of concentrated ammonium hydroxide and 50 mL of water. Once the resulting warm mixture had cooled to 40° C., one liter of ethanol was added with stirring to precipitate the tetraammine nitrate product. The dark purple-blue solid was collected by filtration, washed with ethanol, and air dried. The product was confirmed to be $Cu(NH_3)_4(NO_3)_2$ by elemental analysis. The burning rate of this material as determined from pressed ½-inch diameter pellets was 0.18 inches per second at 1,000 psig.

Example 8

The tetraammine copper nitrate prepared in Example 7 was formulated with various supplemental oxidizers and tested for burning rate. In all cases, 10 g of material were slurried with approximately 10 mL of methanol, dried, and pressed into ½-inch diameter pellets. Burning rates were measured at 1,000 psig, and the results are shown in the following table.

| Copper Tetraammine Nitrate | Oxidizer | Burn Rate (ips) |
|---|---|---|
| 88% | CuO (6%)<br>$Sr(NO_3)_2$ (6%) | 0.13 |
| 92% | $SR(NO_3)_2$ (8%) | 0.14 |
| 90% | $NH_4NO_3$ (10%) | 0.25 |
| 78% | $Bi_2O_3$ (22%) | 0.10 |
| 85% | $SrO_2$ (15%) | 0.18 |

Example 9

A quantity of hexaamminecobalt(III) nitrate was prepared by a replacing ammonium chloride with ammonium nitrate in the procedure for preparing of hexaamminecobalt(III) chloride as taught by G. Pass and H. Sutcliffe, *Practical Inorganic Chemistry,* 2nd Ed., Chapman & Hull, New York, 1974. The material prepared was determined to be $[Co(NH_3)_6](NO_2)_3$ by elemental analysis. A sample of the material was pressed into ½-inch diameter pellets and a burning rate of 0.26 inches per second measured at 2,000 psig.

Example 10

The material prepared in Example 9 was used to prepare three lots of gas generant containing hexaamminecobalt(III) nitrate as the fuel and ceric ammonium nitrate as the co-oxidizer. The lots differ in mode of processing and the presence or absence of additives. Burn rates were determined from ½ inch diameter burn rate pellets. The results are summarized below:

| Formulation | Processing | Burn Rate |
|---|---|---|
| 12% $(NH_4)_2[Ce(NO_3)_6]$<br>88% $[Co(NH)_3)_6](NO_3)_3$ | Dry Mix | 0.19 ips<br>at 1690 psi |
| 12% $(NH_4)_2[Ce(NO_3)_6]$<br>88% $[Co(NH_3)_6](NO_3)_3$ | Mixed with<br>35% MeOH | 0.20 ips<br>at 1690 psi |
| 18% $(NH_4)_2[Ce(NO_3)_6]$<br>81% $[Co(NH_3)_6](NO_3)_3$<br>1% Carbon Black | Mixed with<br>10% $H_2O$ | 0.20 ips<br>at 1690 psi |

Example 11

The material prepared in Example 9 was used to prepare several 10-g mixes of generant compositions utilizing various supplemental oxidizers. In all cases, the appropriate amount of hexaamminecobalt(III) nitrate and co-oxidizer(s) were blended into approximately 10 mL of methanol, allowed to dry, and pressed into ½-inch diameter pellets. The pellets were tested for burning rate at 1,000 psig, and the results are shown in the following table.

| Hexaamminecobalt (III) Nitrate | Co-oxidizer | Burning Rate @ 1,000 psig |
|---|---|---|
| 60% | CuO (40%) | 0.15 |
| 70% | CuO (30%) | 0.16 |
| 83% | CuO (10%)<br>$Sr(NO_3)_2$ (7%) | 0.13 |

-continued

| Hexaamminecobalt (III) Nitrate | Co-oxidizer | Burning Rate @ 1,000 psig |
|---|---|---|
| 88% | $Sr(NO_3)_2$ (12%) | 0.14 |
| 70% | $Bi_2O_3$ (30%) | 0.10 |
| 83% | $NH_4NO_3$ (17%) | 0.15 |

Example 12

Binary compositions of hexaamminecobalt(III) nitrate ("HACN") and various supplemental oxidizers were blended in 20 gram batches. The compositions were dried for 72 hours at 200° F. and pressed into ½-inch diameter pellets. Burn rates were determined by burning the ½ inch pellets at different pressures ranging from 1000 to 4000 psi. The results are shown in the following table.

| Composition | $R_b$ (ips) at X psi | | | | Temp. |
|---|---|---|---|---|---|
| Weight Ratio | 1000 | 2000 | 3000 | 4000 | ° K. |
| HACN 100/0 | 0.19 | 0.28 | 0.43 | 0.45 | 1856 |
| HACN/CuO 90/10 | 0.26 | 0.35 | 0.39 | 0.44 | 1861 |
| HACN/$Ce(NH_4)_2(NO_3)_6$ 88/12 | 0.16 | 0.22 | 0.30 | 0.38 | — |
| HACN/$Co_2O_3$ 90/10 | 0.10 | 0.21 | 0.26 | 0.34 | 1743 |
| HACN/$Co(NO_3)_2.6H_2O$ 90/10 | 0.13 | 0.22 | 0.35 | 0.41 | 1865 |
| HACN/$V_2O_5$ 85/15 | 0.12 | 0.16 | 0.21 | 0.30 | 1802 |
| HACN/$Fe_2O_3$ 75/25 | 0.12 | 0.12 | 0.17 | 0.23 | 1626 |
| HACN/$Co_3O_4$ 81.5/18.5 | 0.13 | 0.20 | 0.25 | 0.30 | 1768 |
| HACN/$MnO_2$ 80/20 | 0.11 | 0.17 | 0.22 | 0.30 | — |
| HACN/$Fe(NO_3)_2.9H_2O$ 90/10 | 0.14 | 0.22 | 0.31 | 0.48 | — |
| HACN/$Al(NO_3)_2.6H_2O$ 90/10 | 0.10 | 0.18 | 0.26 | 0.32 | 1845 |
| HACN/$Mg(NO_3)_2.2H_2O$ 90/10 | 0.16 | 0.24 | 0.32 | 0.39 | 2087 |

Example 13

A processing method was devised for preparing small parallelepipeds ("pps.") of gas generant on a laboratory scale. The equipment necessary for forming and cutting the pps. included a cutting table, a roller and a cutting device. The cutting table consisted of a 9 inch×18 inch sheet of metal with 0.5 inch wide paper spacers taped along the length-wise edges. The spacers had a cumulative height 0.043 inch. The roller consisted of a 1 foot long, 2 inch diameter cylinder of teflon. The cutting device consisted of a shaft, cutter blades and spacers. The shaft was a ¼ inch bolt upon which a series of seventeen ¾ inch diameter, 0.005 inch thick stainless steel washers were placed as cutter blades. Between each cutter blade, four ⅔ inch diameter, 0.020 inch thick brass spacer washers were placed and the series of washers were secured by means of a nut. The repeat distance between the circular cutter blades was 0.085 inch.

A gas generant composition containing a water-soluble binder was dry-blended and then 50–70 g batches were mixed on a Spex mixer/mill for five minutes with sufficient water so that the material when mixed had a dough-like consistency.

A sheet of velostat plastic was taped to the cutting table and the dough ball of generant mixed with water was flattened by hand onto the plastic. A sheet of polyethylene plastic was placed over the generant mix. The roller was positioned parallel to the spacers on the cutting table and the dough was flattened to a width of about 5 inches. The roller was then rotated 90 degrees, placed on top of the spacers, and the dough was flattened to the maximum amount that the cutter table spacers would allow. The polyethylene plastic was peeled carefully off the generant and the cutting device was used to cut the dough both lengthwise and widthwise.

The velostat plastic sheet upon which the generant had been rolled and cut was unfastened from the cutting table and placed lengthwise over a 4 inch diameter cylinder in a 135° F. convection oven. After approximately 10 minutes, the sheet was taken out of the oven and placed over a ½ inch diameter rod so that the two ends of the plastic sheet formed an acute angle relative to the rod. The plastic was moved back and forth over rod so as to open up the cuts between the parallelepipeds ("pps."). The sheet was placed widthwise over the 4 inch diameter cylinder in the 135° F. convection oven and allowed to dry for another 5 minutes. The cuts were opened between the pps. over the ½ inch diameter rod as before. By this time, it was quite easy to detach the pps. from the plastic. The pps. were separated from each other further by rubbing them gently in a pint cup or on the screens of a 12 mesh sieve. This method breaks the pps. into singlets with some remaining doublets. The doublets were split into singlets by use of a razor blade. The pps. were then placed in a convection oven at 165–225° F. to dry them completely. The crush strengths (on edge) of the pps. thus formed were typically as great or greater than those of ⅛ diameter pellets with a ¼ inch convex radius of curvature and a 0.070 inch maximum height which were formed on a rotary press. This is noteworthy since the latter are three times as massive.

Example 14

A gas generating composition was prepared utilizing hexaamminecobalt(III) nitrate, $[(NH_3)_6Co](NO_3)_3$, powder (78.07%, 39.04 g), ammonium nitrate granules (19.93%, 9.96 g), and ground polyacrylamide, MW 15 million (2.00%, 1.00 g). The ingredients were dry-blended in a Spex mixer/mill for one minute. Deionized water (12% of the dry weight of the formulation, 6 g) was added to the mixture which was blended for an additional five minutes on the Spex mixer/mill. This resulted in material with a dough-like consistency which was processed into parallelepipeds (pps.) as in Example 13. Three additional batches of generant were mixed and processed similarly. The pps. from the four batches were blended. The dimensions of the pps. were 0.052 inch×0.072 inch×0.084 inch. Standard deviations on each of the dimensions were on the order of 0.010 inch. The average weight of the pps. was 6.62 mg. The bulk density, density as determined by dimensional measurements, and density as determined by solvent displacement were determined to be 0.86 g/cc, 1.28 g/cc, and 1.59 g/cc, respectively. Crush strengths of 1.7 kg (on the narrowest edge) were measured with a standard deviation of 0.7 kg. Some of the pps. were pressed into ½ inch diameter pellets weighing approximately three grams. From these pellets the burn rate was determined to be 0.13 ips at 1000 psi with a pressure exponent of 0.78.

Example 15

A simulator was constructed according to Example 4. Two grams of a stoichiometric blend of $Mg/Sr(NO_3)_2$/nylon igniter granules were placed into the igniter chamber. The diameter of the ports exiting the outer combustion chamber wall were 3/16 inch. Thirty grams of generant described in Example 14 in the form of parallelepipeds were secured in the combustion chamber. The simulator was attached to the 60 L tank described in Example 4. After ignition, the combustion chamber reached a maximum pressure of 2300 psia in 17 milliseconds, the 60 L tank reached a maximum pressure of 34 psia and the maximum tank temperature was 640°K. The $NO_x$, CO and $NH_3$ levels were 20, 380, and 170 ppm, respectively, and 1600 mg of particulate were collected from the tank.

Example 16

A simulator was constructed with the exact same igniter and generant type and charge weight as in Example 15. In addition the outer combustion chamber exit port diameters were identical. The simulator was attached to an automotive safety bag of the type described in Example 4. After ignition, the combustion chamber reached a maximum pressure of 2000 psia in 15 milliseconds. The maximum pressure of the inflated air bag was 0.9 psia. This pressure was reached 18 milliseconds after ignition. The maximum bag surface temperature was 67° C.

Example 17

A gas generating composition was prepared utilizing hexaamminecobalt(III) nitrate powder (76.29%, 76.29 g), ammonium nitrate granules (15.71%, 15.71 g, Dynamit Nobel, granule size: <350 micron), cupric oxide powder formed pyrometallurgically (5.00%, 5.00 g) and guar gum (3.00%, 3.00 g). The ingredients were dry-blended in a Spex mixer/mill for one minute. Deionized water (18% of the dry weight of the formulation, 9 g) was added to 50 g of the mixture which was blended for an additional five minutes on the Spex mixer/mill. This resulted in material with a dough-like consistency which was processed into parallelepipeds (pps.) as in Example 13. The same process was repeated for the other 50 g of dry-blended generant and the two batches of pps. were blended together. The average dimensions of the blended pps. were 0.070 inch×0.081 inch×0.088 inch. Standard deviations on each of the dimensions were on the order of 0.010 inch. The average weight of the pps. was 9.60 mg. The bulk density, density as determined by dimensional measurements, and density as determined by solvent displacement were determined to be 0.96 g/cc, 1.17 g/cc, and 1.73 g/cc, respectively. Crush strengths of 5.0 kg (on the narrowest edge) were measured with a standard deviation of 2.5 kg. Some of the pps. were pressed into ½ inch diameter pellets weighing approximately three grams. From these pellets the burn rate was determined to be 0.20 ips at 1000 psi with a pressure exponent of 0.67.

Example 18

A simulator was constructed according to Example 4. One gram of a stoichiometric blend of $Mg/Sr(NO_3)_2$/nylon and two grams of slightly over-oxidized $B/KNO_3$ igniter granules were blended and placed into the igniter chamber. The diameter of the ports exiting the outer combustion chamber wall were 0.166 inch. Thirty grams of generant described in Example 17 in the form of parallelepipeds were secured in the combustion chamber. The simulator was attached to the 60 L tank described in Example 4. After ignition, the combustion chamber reached a maximum pressure of 2540 psia in 8 milliseconds, the 60 L tank reached a maximum pressure of 36 psia and the maximum tank temperature was 600°K. The $NO_x$, CO, and $NH_3$ levels were 50, 480, and 800 ppm, respectively, and 240 mg of particulate were collected from the tank.

Example 19

A simulator was constructed with the exact same igniter and generant type and charge weight as in Example 18. In addition the outer combustion chamber exit port diameters were identical. The simulator was attached to an automotive safety bag of the type described in Example 4. After ignition, the combustion chamber reached a maximum pressure of 2700 psia in 9 milliseconds. The maximum pressure of the inflated air bag was 2.3 psig. This pressure was reached 30 milliseconds after ignition. The maximum bag surface temperature was 73° C.

Example 20

A gas generating composition was prepared utilizing hexaamminecobalt(III) nitrate powder (69.50%, 347.5 g), copper(II) trihydroxy nitrate, $[Cu_2(OH)_3NO_3]$, powder (21.5%, 107.5 g), 10 micron RDX (5.00%, 25 g), 26 micron potassium nitrate (1.00%, 5 g) and guar gum (3.00%, 3.00 g). The ingredients were dry-blended with the assistance of a 60 mesh sieve. Deionized water (23% of the dry weight of the formulation, 15 g) was added to 65 g of the mixture which was blended for an additional five minutes on the Spex mixer/mill. This resulted in material with a dough-like consistency which was processed into parallelepipeds (pps.) as in Example 13. The same process was repeated for two additional 65 g batches of dry-blended generant and the three batches of pps. were blended together. The average dimensions of the pps. were 0.057 inch×0.078 inch×0.084 inch. Standard deviations on each of the dimensions were on the order of 0.010 inch. The average weight of the pps. was 7.22 mg. The bulk density, density as determined by dimensional measurements, and density as determined by solvent displacement were determined to be 0.96 g/cc, 1.23 g/cc, and 1.74 g/cc, respectively. Crush strengths of 3.6 kg (on the narrowest edge) were measured with a standard deviation of 0.9 kg. Some of the pps. were pressed into ½ inch diameter pellets weighing approximately three grams. From these pellets the burn rate was determined to be 0.27 ips at 1000 psi with a pressure exponent of 0.51.

Example 21

A simulator was constructed according to Example 4. 1.5 grams of a stoichiometric blend of $Mg/Sr(NO_3)_2$/nylon and 1.5 grams of slightly over-oxidized $B/KNO_3$ igniter granules were blended and placed into the igniter chamber. The diameter of the ports exiting the outer combustion chamber wall were 0.177 inch. Thirty grams of generant described in Example 20 in the form of parallelepipeds were secured in the combustion chamber. The simulator was attached to the 60 L tank described in Example 4. After ignition, the combustion chamber reached a maximum pressure of 3050 psia in 14 milliseconds. The $NO_x$, CO, and $NH_3$ levels were 25, 800, and 90 ppm, respectively, and 890 mg of particulate were collected from the tank.

Example 22

A gas generating composition was prepared utilizing hexaamminecobalt(III) nitrate powder (78.00%, 457.9 g), copper(II) trihydroxy nitrate powder (19.00%, 111.5 g), and guar gum (3.00%, 17.61 g). The ingredients were dry-blended and then mixed with water (32.5% of the dry weight of the formulation, 191 g) in a Baker-Perkins pint mixer for 30 minutes. To a portion of the resulting wet cake (220 g), 9.2 additional grams of copper(II) trihydroxy nitrate and 0.30 additional grams of guar gum were added as well as 0. 80 g of carbon black (Monarch 1100). This new formulation was blended for 30 minutes on a Baker-Perkins mixer. The wet cake was placed in a ram extruder with a barrel diameter of 2 inches and a die orifice diameter of 3/32 inch (0.09038 inch). The extruded material was cut into lengths of about one foot, allowed to dry under ambient conditions overnight, placed into an enclosed container holding water in order to moisten and thus soften the material, chopped into lengths of about 0.1 inch and dried at 165° F. The dimensions of the resulting extruded cylinders were an average length of 0.113 inches and an average diameter of 0.091 inches. The bulk density, density as determined by dimensional measurements, and density as determined by solvent displacement were 0.86 g/cc, 1.30 g/cc, and 1.61 g/cc, respectively. Crush strengths of 2.1 and 4.1 kg were measured on the circumference and axis, respectively. Some of the extruded cylinders were press ed into ½ inch diameter pellets weighing approximately three grams. From these pellets the burn rate was determined to be 0.22 ips at 1000 psi with a pressure exponent of 0.29.

Example 23

Three simulators were constructed according to Example 4. 1.5 grams of a stoichiometric blend of $Mg/Sr(NO_3)_2$/nylon and 1.5 grams of slightly over-oxidized $B/KNO_3$ igniter granules were blended and placed into the igniter chambers. The diameter of the ports exiting the outer combustion chamber wall were 0.177 inch, 0.166 inch, and 0.152 inch, respectively. Thirty grams of generant described in Example 22 in the form of extruded cylinders were secured in each of the combustion chambers. The simulators were, in succession, attached to the 60 L tank described in Example 4. After ignition, the combustion chambers reached a maximum pressure of 1585, 1665, and 1900 psia, respectively. Maximum tank pressures were 32, 34, and 35 psia, respectively. The $NO_x$, levels were 85, 180, and 185 ppm whereas the CO levels were 540, 600, and 600 ppm, respectively. $NH_3$ levels were below 2 ppm. Particulate levels were 420, 350, and 360 mg, respectively.

Example 24

The addition of small amounts of carbon to gas generant formulations have been found to improve the crush strength of parallelepipeds and extruded pellets formed as in Example 13 or Example 22. The following table summarizes the crush strength enhancement with the addition of carbon to a typical gas generant composition within the scope of the present invention. All percentages are expressed as weight percent.

TABLE 3

Crush Strength Enhancement with Addition of Carbon

| % HACN | % CTN | % Guar | % Carbon | Form | Strength |
|---|---|---|---|---|---|
| 65.00 | 30.00 | 5.00 | 0.00 | EP | 2.7 kg |
| 64.75 | 30.00 | 4.50 | 0.75 | EP | 5.7 kg |
| 78.00 | 19.00 | 3.00 | 0.00 | pps. | 2.3 kg |
| 72.90 | 23.50 | 3.00 | 0.60 | pps. | 5.8 kg |
| 78.00 | 19.00 | 3.00 | 0.00 | EP | 2.3 kg |
| 73.00 | 23.50 | 3.00 | 0.50 | EP | 4.1 kg |

HACN = hexaamminecobalt(III) nitrate, $[(NH_3)_6Co](NO_3)_3$ (Thiokol)
CTN = copper(II) trihydroxy nitrate, $[Cu_2(OH_3)NO_3]$ (Thiokol)
Guar = guar gum (Aldrich)
Carbon = "Monarch 1100" carbon black (Cabot)
EP = extruded pellet (see Example 22)
pps. = parallelepipeds (see Example 13)
strength = crush strength of pps. or extruded pellets in kilograms.

Example 25

Hexaamminecobalt(III) nitrate was pressed into four gram pellets with a diameter of ½ inch. One half of the pellets were weighed and placed in a 95° C. oven for 700 hours. After aging, the pellets were weighed once again. No loss in weight was observed. The burn rate of the pellets held at ambient temperature was 0.16 ips at 1000 psi with a pressure exponent of 0.60. The burn rate of the pellets held at 95° C. for 700 hours was 0.15 at 1000 psi with a pressure exponent of 0.68.

Example 26

A gas generating composition was prepared utilizing hexaamminecobalt(III) nitrate powder (76.00%, 273.6 g), copper(II) trihydroxy nitrate powder (16.00%, 57.6 g), 26 micron potassium nitrate (5.00%, 18.00 g), and guar gum (3.00%, 10.8 g). Deionized water (24.9% of the dry weight of the formulation, 16.2 g) was added to 65 g of the mixture which was blended for an additional five minutes on the Spex mixer/mill. This resulted in material with a dough-like consistency which was processed into parallelepipeds (pps.) as in Example 13. The same process was repeated for the other 50–65 g batches of dry-blended generant and all the batches of pps. were blended together. The average dimensions of the pps. were 0.065 inch×0.074 inch×0.082 inch. Standard deviations on each of the dimensions were on the order of 0.005 inch. The average weight of the pps. was 7.42 mg. The bulk density, density as determined by dimensional measurements, and density as determined by solvent displacement were determined to be 0.86 g/cc, 1.15 g/cc, and 1.68 g/cc, respectively. Crush strengths of 2.1 kg (on the narrowest edge) were measured with a standard deviation of 0.3 kg. Some of the pps. were pressed into ten, one half inch diameter pellets weighing approximately three grams. Approximately 60 g of pps. and five ½ inch diameter pellets were placed in an oven held at 107° C. After 450 hours at this temperature, 0.25% and 0.41% weight losses were observed for the pps. and pellets, respectively. The remainder of the pps. and pellets were stored under ambient conditions. Burn rate data were obtained from both sets of pellets and are summarized in Table 4.

TABLE 4

Burn Rate Comparison Before and After Accelerated Aging

| Storage Conditions | Burn Rate at 1000 psi | Pressure Exponent |
|---|---|---|
| 24–48 Hours @ Ambient | 0.15 ips | 0.72 |
| 450 Hours @ 107° C. | 0.15 ips | 0.70 |

Example 27

Two simulators were constructed according to Example 4. In each igniter chamber, a blended mixture of 1.5 g of a stoichiometric blend of $Mg/Sr(NO_3)_2$/nylon and 1.5 grams of slightly over-oxidized $B/KNO_3$ igniter granules were placed. The diameter of the ports exiting the outer combustion chamber wall in each simulator were 0.177 inch. Thirty grams of ambient aged generant described in Example 26 in the form of parallelepipeds were secured in the combustion chamber of one simulator whereas thirty grams of generant pps. aged at 107° C. were placed in the other combustion chamber. The simulators were attached to the 60 L tank described in Example 4. Test fire results are summarized in Table 5 below.

TABLE 5

Test-Fire Results for Aged Generant

| Aging Temp. | Comb. Press. (psia) | Tank Press. (psia) | Tank Temp. (° K.) | $NH_3$ Level (ppm) | CO Level (ppm) | $NO_x$ Level (ppm) | Part. Level (mg) |
|---|---|---|---|---|---|---|---|
| Amb. | 2171 | 31.9 | 628 | 350 | 500 | 80 | 520 |
| 107° C. | 2080 | 31.6 | 629 | 160 | 500 | 100 | 480 |

Example 28

A mixture of $2Co(NH_3)_3(NO_2)_3$ and $Co(NH_3)_4(NO_2)_2Co(NH_3)_2(NO_2)_4$ was prepared and pressed in a pellet having a diameter of approximately 0.504 inches. The complexes were prepared within the scope of the teachings of the Hagel, et al. reference identified above. The pellet was placed in a test bomb, which was pressurized to 1,000 psi with nitrogen gas.

The pellet was ignited with a hot wire and burn rate was measured and observed to be 0.38 inches per second. Theoretical calculations indicated a flame temperature of 1805° C. From theoretical calculations, it was predicted that the major reaction products would be solid CoO and gaseous reaction products. The major gaseous reaction products were predicted to be as follows:

| Product | Volume % |
|---|---|
| $H_2O$ | 57.9 |
| $N_2$ | 38.6 |
| $O_2$ | 3.1 |

Example 29

A quantity of $Co(NH_3)_3(NO_2)_3$ was prepared according to the teachings of Example 1 and tested using differential scanning calorimetry. It was observed that the complex produced a vigorous exotherm at 200° C.

Example 30

Theoretical calculations were undertaken for $Co(NH_3)_3(NO_2)_3$. Those calculations indicated a flame temperature of about 2,000°K and a gas yield of about 1.75 times that of a conventional sodium azide gas generating compositions based on equal volume of generating composition ("performance ratio"). Theoretical calculations were also undertaken for a series of gas generating compositions. The composition and the theoretical performance data is set forth below in Table 6.

TABLE 6

| Gas Generant | Ratio | Temp. (° C.) | Perf. Ratio |
|---|---|---|---|
| $Co(NH_3)_3(NO_2)_3$ | — | 1805 | 1.74 |
| $NH_4[Co(NH_3)_2(NO_2)_4]$ | — | 1381 | 1.81 |
| $NH_4[CO(NH_3)_2(NO_2)_4]/B$ | 99/1 | 1634 | 1.72 |
| $Co(NH_3)_6(NO_3)_3$ | — | 1585 | 2.19 |
| $[Co(NH_3)_5(NO_3)](NO_3)_2$ | — | 1637 | 2.00 |
| $[Fe(N_2H_4)_3](NO_3)_2/Sr(NO_3)_2$ | 87/13 | 2345 | 1.69 |
| $[Co(NH_3)_6](ClO_4)_3/CaH_2$ | 86/14 | 2577 | 1.29 |
| $[Co(NH_3)_5(NO_2)](NO_3)_2$ | — | 1659 | 2.06 |

TABLE 6-continued

| Gas Generant | Ratio | Temp. (° C.) | Perf. Ratio |
|---|---|---|---|

Performance ratio is a normalized relation to a unit volume of azide-based gas generant. The theoretical gas yield for a typical sodium azide-based gas generant (68 wt. % $NaN_3$; 30 wt % of $MoS_2$; 2 wt % of S) is about 0.85 g gas/cc $NaN_3$ generant.

Example 31

Theoretical calculations were conducted on the reaction of $[Co(NH_3)_6](ClO_4)_3$ and $CaH_2$ as listed in Table 6 to evaluate its use in a hybrid gas generator. If this formulation is allowed to undergo combustion in the presence of 6.80 times its weight in argon gas, the flame temperature decreases from 2577° C. to 1085° C., assuming 100% efficient heat transfer. The output gases consist of 86.8% by volume argon, 1600 ppm by volume hydrogen chloride, 10.2% by volume water, and 2.9% by volume nitrogen. The total slag weight would be 6.1% by mass.

Example 32

Pentaamminecobalt(III) nitrate complexes were synthesized which contain a common ligand in addition to $NH_3$. Aquopentaamminecobalt(III) nitrate and pentaamminecarbonatocobalt(III) nitrate were synthesized according to *Inorg. Syn.,* vol. 4, p. 171 (1973). Pentaamminehydroxocobalt(III) nitrate was synthesized according to H. J. S. King, *J. Chem. Soc.,* p. 2105 (1925) and 0. Schmitz, et al., *Zeit. Anorg. Chem.,* vol. 300, p. 186 (1959). Three lots of gas generant were prepared utilizing the pentaamminecobalt(III) nitrate complexes described above. In all cases guar gum was added as a binder. Copper(II) trihydroxy nitrate, $[Cu_2(OH)_3NO_3]$, was added as the co-oxidizer where needed. Burn rates were determined from ½ inch diameter burn rate pellets. The results are summarized below in Table 7.

TABLE 7

Formulations Containing $[Co(NH_3)_5X](NO_3)_y$

| Formulation | % $H_2O$ Added | Burn Rate |
|---|---|---|
| 97.0% $[Co(NH_3)_5(H_2O)](NO_3)_3$<br>3% guar | 27% | 0.16 ips<br>at 1000 psi |
| 68.8% $[Co(NH_3)_5(OH)](NO_3)_2$<br>28.2% $[Cu_2(OH)_3NO_3]$<br>3.0% guar | 55% | 0.14 ips<br>at 1000 psi |
| 48.5 $[Ca(NH_3)_5(CO_3)](NO_3)$<br>48.5% $[Cu_2(OH)_3NO_3$<br>3.0% guar | 24% | 0.06 ips<br>at 4150 psi |

Example 33

A formulation was prepared comprising the following starting ingredients: 1) 72.84 wt. % cobalthexaammine nitrate, 2) 21.5 wt. % basic copper nitrate, 3) 5.0 wt. % guar gum, and 4) 0.66 wt. % carbon.

The formulation was processed as described in Example 22 except a single screw extruder was employed and the extruded cylinders incorporated a 0.035 inch center perforation. The formulations were tested by the same procedure described in Example 23 at various loadings ranging from 32 to 38 grams. The test results showed that particulate values were between 0.6 g and 1.0 g for all samples. The tank pressures ranged from 39 to 48 psia depending on load.

Example 34

A formulated blend to be extruded was prepared comprising: 1) 38.75 wt. % basic copper nitrate, 2) 36.38 wt. % hexaaminecobaltnitrate, 3) 19.5 wt. % guanidine nitrate, 4) 5.0 wt. % guar gum, and 5) 0.37 wt. % carbon black. The blend was prepared by mixing the ingredients according to the procedure described in Example 33.

An initial test evaluation was carried out with a 35 g sample of extruded material as described in Example 23. The combustion pressure was 2808 psi, and the tank pressure was 39.9 psia. The amounts of trace gas products were: ammonia (70 ppm), $NO_x$ (40 ppm), and CO (600 ppm). The particulate values were only 0.281 g. The observed tank pressure of 39.9 psia compared to that obtained with 33 g of formulation prepared according to Example 33, which typically provided 39 to 40 psia under like conditions.

Example 35

A formulated blend to be extruded was prepared comprising: 1) 40.34 wt. % basic copper nitrate, 2) 37.86 wt. % hexaaminecobaltnitrate, 3) 15.8 wt. % guanidine nitrate, 4) 5.7 wt. % guar gum, and 5) 0.3 wt. % carbon black. The blend was prepared by mixing the ingredients according to the procedure described in Examples 33 and 34. Results comparable to those of Example 34 were expected and obtained.

Gas generants are described in U.S. application Ser. No. 08/507,552 filed Jul. 26, 1995, which is a continuation-in-part application of U.S. application Ser. No. 08/184,456, filed Jan. 19, 1994, the complete disclosures of which are hereby incorporated by reference.

SUMMARY

In summary the present invention provides gas generating materials that overcome some of the limitations of conventional azide-based gas generating compositions. The complexes of the present invention produce nontoxic gaseous products including water vapor, oxygen, and nitrogen. Certain of the complexes are also capable of efficient decomposition to a metal or metal oxide, and nitrogen and water vapor. Finally, reaction temperatures and burn rates are within acceptable ranges.

The invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A gas generating composition comprising:

a complex of a metal cation, at least one neutral ligand containing hydrogen and nitrogen, and sufficient oxidizing anion to balance the charge of the metal cation such that when the complex combusts, a mixture of gases containing nitrogen gas and water vapor is produced; and at least one cool burning organic nitrogen-containing compound.

2. A gas generating composition as defined in claim 1, wherein the complex is selected from the group consisting of metal nitrite ammines, metal nitrate ammines, metal perchlorate ammines, metal nitrite hydrazines, metal nitrate hydrazines, metal perchlorate hydrazines, and mixtures thereof.

3. A gas generating composition as defined in claim 1, wherein the complex is a metal nitrite ammine.

4. A gas generating composition as defined in claim 1, wherein the complex is a metal nitrate ammine.

5. A gas generating composition as defined in claim 1, wherein the complex is a metal perchlorate ammine.

6. A gas generating composition as defined in claim 1, wherein the complex is a metal nitrite hydrazine.

7. A gas generating composition as defined in claim 1, wherein the complex is a metal nitrate hydrazine.

8. A gas generating composition as defined in claim 1, wherein the complex is a metal perchlorate hydrazine.

9. A gas generating composition as defined in claim 1, wherein the metal cation is a transition metal, alkaline earth metal, metalloid, or lanthanide metal cation.

10. A gas generating composition as defined in claim 9, wherein the metal cation is selected from the group consisting of magnesium, manganese, nickel, titanium, copper, chromium, zinc, and tin.

11. A gas generating composition as defined in claim 1, wherein the metal cation is a transition metal cation.

12. A gas generating composition as defined in claim 11, wherein the transition metal cation is cobalt.

13. A gas generating composition as defined in claim 11, wherein the transition metal cation is selected from the group consisting of rhodium, iridium, ruthenium, palladium, and platinum.

14. A gas generating composition as defined in claim 1, wherein the oxidizing anion is coordinated with the metal cation.

15. A gas generating composition as defined in claim 1, wherein the oxidizing anion is selected from the group consisting of nitrate, nitrite, chlorate, perchlorate, peroxide, and superoxide.

16. A gas generating composition as defined in claim 1, wherein the inorganic oxidizing anion and the inorganic neutral ligand are free of carbon.

17. A gas generating composition as defined in claim 1, wherein the complex includes at least one other common ligand, in addition to the neutral ligand.

18. A gas generating composition as defined in claim 17, wherein the common ligand is selected from the group consisting of aquo ($H_2O$), hydroxo (OH), perhydroxo ($O_2H$), peroxo ($O_2$), carbonate ($CO_3$), carbonyl (CO), oxalato ($C_2O_4$), nitrosyl (NO), cyano (CN), isocyanato (NC), isothiocyanato (NCS), thiocyanato (SCN), amido ($NH_2$), imdo (NH), sulfato ($SO_4$), chloro (Cl), fluoro (F), phosphato ($PO_4$), and ethylenediaminetetraacetic acid (EDTA) ligands.

19. A gas generating composition as defined in claim 1, wherein the complex includes a common counter ion in addition to the oxidizing anion.

20. A gas generating composition as defined in claim 19, wherein the common counter ion is selected from the group consisting of hydroxide ($OH^-$), chloride ($Cl^-$), fluoride ($F^-$), cyanide ($CN^-$), thiocyanate ($SCN^-$), carbonate ($Co_3^{-2}$), sulfate ($SO_4^{-2}$), phosphate ($PO_4^{-3}$), oxalate ($C_2O_4^{-2}$), borate ($BO_4^{-5}$), and ammonium ($NH_4^+$) counter ions.

21. A gas generating composition as defined in claim 1, wherein the complex has a concentration in the gas generating composition from 30% to 90% by weight, wherein the gas generating composition further comprises a binder and a co-oxidizer such that the binder has a concentration in the gas generating composition from 0.5% to 12% by weight, and wherein the sum of the amount of co-oxidizer and cool burning compound in the gas generating composition is from 10% to 60% by weight.

22. A gas generating composition as defined in claim 1, further comprising a co-oxidizer other than said cool burning compound.

23. A gas generating composition as defined in claim 22, wherein the co-oxidizer is selected from alkali, alkaline earth, lanthanide, or ammonium perchlorates, chlorates, peroxides, nitrites, and nitrates.

24. A gas generating composition as defined in claim 22, wherein the co-oxidizer is selected from metal oxides, metal hydroxides, metal peroxides, metal oxide hydrates, metal oxide hydroxides, metal hydrous oxides, basic metal carbonates, basic metal nitrates, and mixtures thereof.

25. A gas generating composition as defined in claim 22, wherein the co-oxidizer is selected from oxides of copper, cobalt, manganese, tungsten, bismuth, molybdenum, and iron.

26. A gas generating composition as defined in claim 22, wherein the co-oxidizer is a metal oxide selected from CuO, $Co_2O_3$, $Co_3O_4$, $CoFe_2O_4$, $Fe_2O_3$, $MoO_3$, $Bi_2MoO_6$, and $Bi_2O_3$.

27. A gas generating composition as defined in claim 22, wherein the co-oxidizer is a metal hydroxide selected from $Fe(OH)_3$, $Co(OH)_3$, $Co(OH)_2$, $Ni(OH)_2$, $Cu(OH)_2$, and $Zn(OH)_2$.

28. A gas generating composition as defined in claim 22, wherein the co-oxidizer is a metal oxide hydrate or metal hydrous oxide selected from $Fe_2O_3.xH_2O$, $SnO_2.xH_2O$, and $MoO_3.H_2O$.

29. A gas generating composition as defined in claim 22, wherein the co-oxidizer is a metal oxide hydroxide selected from $CoO(OH)_2$, $FeO(OH)_2$, $MnO(OH)_2$, and $MnO(OH)_3$.

30. A gas generating composition as defined in claim 22, wherein the co-oxidizer is a basic metal carbonate selected from $CuCO_3.Cu(OH)_2$ (malachite), $2Co(CO_3).3Co(OH)_2.H_2O$, $Co_{0.69}Fe_{0.34}(CO_3)_{0.2}(OH)_2$, $Na_3[Co(CO_3)_3].3H_2O$, $Zn_2(CO_3)(OH)_2$, $Bi_2Mg(CO_3)_2(OH)_4$, $Fe(CO_3)_{0.12}(OH)_{2.76}$, $Cu_{1.54}Zn_{0.46}(CO_3)(OH)_2$, $Co_{0.49}Cu_{0.51}(CO_3)_{0.43}(OH)_{1.1}$, $Ti_3Bi_4(CO_3)_2(OH)_2O_9(H_2O)_2$, and $(BiO)_2CO_3$.

31. A gas generating composition as defined in claim 22, wherein the co-oxidizer is a basic metal nitrate selected from $Cu_2(OH)_3NO_3$, $Co_2(OH)_3NO_3$, $CuCo(OH)_3NO_3$, $Zn_2(OH)_3NO_3$, $Mn(OH)_2NO_3$, $Fe_4(OH)_{11}NO_32H_2O$, $Mo(NO_3)_2O_2$, $BiONO_3.H_2O$, and $Ce(OH)(NO_3)_3.3H_2O$.

32. A gas generating composition as defined in claim 1, further comprising a binder.

33. A gas generating composition as defined in claim 32, wherein the binder is water soluble.

34. A gas generating composition as defined in claim 33, wherein the binder is selected from naturally occurring gums, polyacrylic acids, and polyacrylamides.

35. A gas generating composition as defined in claim 32, wherein the binder is not water soluble.

36. A gas generating composition as defined in claim 35, wherein the binder is selected from nitrocellulose, VAAR, and nylon.

37. A gas generating composition as defined in claim 1, wherein the complex is hexaamminecobalt(III) nitrate, ($[(NH_3)_6Co](NO_3)_3$) and the co-oxidizer is copper(II) trihydroxy nitrate ($Cu_2(OH)_3NO_3$).

38. A gas generating composition as defined in claim 1, further comprising carbon powder present from 0.1% to 6% by weight of the gas generating composition, wherein the composition exhibits improved crush strength compared to the composition without carbon powder.

39. A gas generating composition as defined in claim 1, further comprising carbon powder present from 0.3% to 3% by weight of the gas generating composition.

40. A gas generating device comprising:

a gas generating composition comprising:

a complex of a transition metal cation or alkaline earth metal cation and a neutral ligand containing hydrogen and nitrogen, such that when the complex combusts, a mixture of gases containing nitrogen gas and water vapor is produced;

sufficient oxidizing anion to balance the charge of the metal cation; and at least one cool burning organic nitrogen-containing compound; and an ignitor for initiating the combustion of the composition.

41. A gas generating device as defined in claim 40, wherein the ignitor for initiating the combustion includes an igniter composition comprising a mixture of different igniter compositions.

42. A gas generating device as defined in claim 40, wherein the ignitor for initiating the combustion includes an igniter composition comprising a mixture of $Mg/Sr(NO_3)_2$/nylon and $B/KNO_3$.

43. An automobile air bag system comprising:

a collapsed, inflatable air bag;

a gas-generating device connected to the air bag for inflating the air bag, the gas-generating device containing a gas-generating composition comprising:

a complex of a transition metal cation or alkaline earth metal cation and a neutral ligand containing hydrogen and nitrogen, such that when the complex combusts, a mixture of gases containing nitrogen gas and water vapor is produced;

sufficient oxidizing anion to balance the charge of the metal cation; and and at least one cool burning organic nitrogen-containing compound; and an ignitor to ignite the gas-generating composition.

44. A vehicle containing a supplemental restraint system having an air bag system comprising:

a collapsed, inflatable air bag;

a gas-generating device connected to the air bag for inflating the air bag, the gas-generating device containing a gas-generating composition comprising:

a complex of a transition metal cation or alkaline earth metal cation and a neutral ligand containing hydrogen and nitrogen, such that when the complex combusts, a mixture of gases containing nitrogen gas and water vapor is produced;

sufficient oxidizing anion to balance the charge of the metal cation; and at least one cool burning organic nitrogen-containing compound; and an ignitor for igniting the gas-generating composition.

45. A gas generating composition as defined in claim 1, wherein said cool burning compound has a heat of formation of less than about −400 cal/g.

46. A gas generating composition as defined in claim 1, wherein said cool burning compound has a heat of formation of less than about −600 cal/g.

47. A gas generating composition as defined in claim 1, wherein said cool burning compound is a guanidine salt or a guanidine derivative.

48. A gas generating composition as defined in claim 1, wherein said cool burning compound is guanidine nitrate.

49. A gas generating composition as defined in claim 1, wherein the amount of said cool burning compound is greater than about 0 wt. % and up to about 40 wt. %.

* * * * *